US005427041A

United States Patent [19]

Satoma

[11] Patent Number: 5,427,041

[45] Date of Patent: Jun. 27, 1995

[54] UPPER KNIFE RELEASING DEVICE IN AN OVERLOCK SEWING MACHINE

[75] Inventor: Shiro Satoma, Tokyo, Japan

[73] Assignee: Juki Corporation, Tokyo, Japan

[21] Appl. No.: 246,422

[22] Filed: May 20, 1994

[30] Foreign Application Priority Data

May 21, 1993 [JP] Japan ..... 5-119854
Jun. 30, 1993 [JP] Japan ..... 5-160684

[51] Int. Cl.[6] ..... D05B 37/06
[52] U.S. Cl. ..... 112/125
[58] Field of Search ..... 112/122, 162, 129, 122.1, 112/122.2, 125, 130, 178, 197, 217, 168; 83/910, 918

[56] References Cited

U.S. PATENT DOCUMENTS

| | | | |
|---|---|---|---|
| 4,167,042 | 1/1965 | Bono | 112/122.1 |
| 4,248,166 | 2/1981 | Kamiya | 112/122 |
| 4,384,540 | 5/1983 | Vollmar et al. | 112/122.1 X |
| 4,773,342 | 9/1988 | Fietta | 112/122 X |
| 5,289,789 | 3/1994 | Sakuma | 112/122 |

*Primary Examiner*—Clifford D. Crowder
*Assistant Examiner*—Ismael Izaguirre
*Attorney, Agent, or Firm*—Finnegan, Henderson Farabow, Garrett & Dunner

[57] ABSTRACT

In an overlock sewing machine for an overedge stitch and at least one kind of chain stitch other than the overedge stitch, an upper knife releasing device according to the invention comprises: an upper knife rocking arm 26 to which an cloth cutting upper knife 30 is secured; an upper knife rocking shaft 28 which is fixedly secured to the upper knife rocking arm and is rotatably supported relative to a frame; a controller shaft 50; and a controller 52 having a guide groove 52*a*, the controller being rotatable about the controller shaft, a link mechanism (38 and 34) having one end which is linearly reciprocated along the guide groove, and the other end which is fixedly secured to the upper knife rocking shaft. In the device, a controller rotating mechanism controls the rotational angle of the controller so that the upper knife rocking shaft is allowed to turn in the case of a chain stitch in which the knife is used, and the upper knife rocking shaft is not allowed to turn in the case of a chain stitch in which the knife is not used, and also a controller shaft moving mechanism moves the controller shaft so that the upper knife rocking arm is moved downwardly in the case of a chain stitch in which the knife is used, and the upper knife rocking arm is retracted upwardly in the case of a chain stitch in which the knife is not used.

20 Claims, 11 Drawing Sheets

UPPER KNIFE RELEASING DEVICE IN AN OVERLOCK SEWING MACHINE

BACKGROUND OF THE INVENTION

This invention relates to upper knife releasing devices for overlock sewing machines, and more particularly to an upper knife releasing device suitably employed in the overlock sewing machine for use in forming overedge stitches, double chainstitches, and specially established stitches other than those.

When the overedge stitches are formed by the overlock sewing machine, the workpiece or work is cut or trimmed by a slide movement of upper and lower knives. A work cutter or trimmer to be used to this end has been heretofore well known as what is arranged so that the upper knife is supported by vertically swingable member which is vertically driven by an upper knife drive element or means that uses the main shaft as a drive source.

A conventional approach has been heretofore so made, if such overlock sewing machine of this class is used in forming either overedge stitches by way of work cutting or both of double stitches and special established stitches by way of no work cutting, as to render the upper knife inactive to this end.

The above-described conventional sewing machine is disadvantageous in the following points: Even when the upper knife is moved away from the lower knife by turning it with respect to the upper knife rocking arm, the latter is left turned. The upper knife rocking arm is not only hazardous but also obstructive over the sewing machine table during sewing work, thus limiting the work space. More specifically, it is rather difficult to thread the needle and to replace the needle.

SUMMARY OF THE INVENTION

Accordingly, an object of this invention is to provide an upper knife releasing device for an overlock sewing machine in which a link mechanism for rocking the upper knife rocking arm and a controller having a guide groove are used to reciprocate one end of the link mechanism along the guide groove, so that in a double chainstitching operation or in a special stitching operation, the rotational angle of the controller is so adjusted as to prevent the rotation of the upper knife rocking arm, thereby to stop the latter.

Another object of the invention is to provide an upper knife releasing device for an overlock sewing machine in which the controller is moved to retract the upper knife rocking arm upwardly, thereby to improve the safety and to increase the work space.

Still further object of this invention is to provide an upper knife releasing device for an overlock sewing machine with which, the upper knife is not hazardous, and the work space is large enough, in a double chainstitch or in a special stitch.

The foregoing objects of the invention have been achieved by the provision of the following means:

an upper knife releasing device in an overlock sewing machine for forming at least one shape of a stitch more than an overedge stitch and the like, according to a first aspect of the invention, comprises:

an upper knife rocking arm to which an cloth cutting upper knife is secured;

an upper knife rocking shaft which is fixedly secured to the upper knife rocking arm and is rotatably supported;

a controller shaft;

a controller having a guide groove, the controller being rotatable about the controller shaft, a link mechanism having one end which is substantially linearly reciprocated along the guide groove, and the other end which is fixedly secured to the upper knife rocking shaft; and controller rotating means for controlling the rotational angle of the controller so that the upper knife rocking shaft is allowed to turn in the case of a chain stitch in which the knife is used, and the upper knife rocking shaft is not allowed to turn in the case of a chain stitch in which the knife is not used.

In addition, an upper knife releasing device in an overlock sewing machine for forming at least one shape of a stitch more than an overedge stitch, according to a second aspect of the invention, comprises:

an upper knife rocking arm to which an cloth cutting upper knife is secured;

an upper knife rocking shaft which is fixedly secured to the upper knife rocking arm and is rotatably supported;

a controller shaft;

a controller having a guide groove, the controller being rotatable about the controller shaft, a link mechanism having one end which is substantially linearly reciprocated along the guide groove, and the other end which is fixedly secured to the upper knife rocking shaft; and controller shaft moving means for moving the controller shaft so that the upper knife rocking arm is moved downwardly in the case of a chain stitch in which the knife is used, and the upper knife rocking arm is retracted upwardly in the case of a chain stitch in which the knife is not used.

Further, an upper knife releasing device in an overlock sewing machine for forming at least one shape of a stitch more than an overedge stitch, according to a third aspect of the invention, comprises:

an upper knife rocking arm to which an cloth cutting upper knife is secured;

an upper knife rocking shaft which is fixedly secured to the upper knife rocking arm and is rotatably supported;

a controller shaft;

a controller having a guide groove, the controller being rotatable about the controller shaft, a link mechanism having one end which is substantially linearly reciprocated along the guide groove, and the other end which is fixedly secured to the upper knife rocking shaft;

controller rotating means for controlling the rotational angle of the controller so that the upper knife rocking shaft is allowed to turn in the case of a chain stitch in which the knife is used, and the upper knife rocking shaft is not allowed to turn in the case of a chain stitch in which the knife is not used;

controller shaft moving means for moving the controller shaft so that the upper knife rocking arm is moved downwardly in the case of a chain stitch in which the knife is used, and the upper knife rocking arm is retracted upwardly in the case of a chain stitch in which the knife is not used; and a change-over lever for simultaneously allowing the controller rotating means and the controller shaft moving means to operate.

Still further, an upper knife releasing device for an overlock sewing machine which is arranged to form at least one shape of a stitch more than a overedge stitch; which, according to a fourth aspect of the invention, comprises:

an upper knife rocking arm to which a cloth cutting upper knife is secured;

upper knife driving means for rocking the upper knife rocking arm vertically;

an upper knife releasing hold plate secured to a sewing machine frame located above the upper knife driving means; and switching means for coupling the upper knife rocking arm to the upper knife driving means in the case of a stitch in which a knife is used, and fixing the upper knife rocking arm to the upper knife releasing hold plate in the case of a stitch in which the knife is not used.

Preferably, in the upper knife releasing device, the switching means is provided on the outer casing of the overlock sewing machine.

The upper knife releasing device further comprises: a coupling pin; elastic means for urging the coupling pin away from the upper knife rocking arm, and holding means for holding and releasing the coupling pin with respect to the upper knife rocking arm. In the device, the upper knife driving means and the upper knife releasing hold plate have engaging holes, respectively, with which the coupling pin is engageable. The coupling pin is engaged with the engaging hole of the upper knife driving means in the case of a stitch in which the knife is used, and engaged with the engaging hole of the upper knife releasing hold plate in the case of a stitch in which the knife is not used, to secure the upper knife rocking arm to the upper knife releasing hold plate.

Furthermore, in the upper knife releasing device, that upper knife driving means includes: a sloped surface, and a stopper for preventing the downward movement of the coupling pin, while the upper knife releasing hold plate includes: a sloped surface, and a stopper form preventing the upward movement of the coupling pin. In the case of a stitch in which the knife is used, the coupling pin is slid down the sloped surface of the upper knife driving means until the coupling abuts against the stopper, thus being engaged with the engaging hole. On the other hand, in the case of a stitch in which the knife is not used, the coupling pin is slid up the sloped surface of the upper knife releasing hold plate until the coupling pin abuts against the stopper, thus being engaged with the engaging hole.

In the case of a stitch in which the knife is used, the switching means is operated to couple the upper knife rocking arm to the upper knife driving means so that the upper knife rocking arm may be swung vertically by the upper knife driving means. In the case of a stitch in which the knife is not used, the switching means is operated so that the upper knife rocking arm is decouple from the upper knife driving means and secured to the upper knife releasing hold plate. The upper knife releasing hold plate is secured to the sewing machine frame located above the upper knife driving means, and therefore the upper knife rocking arm is fixedly held above the auxiliary bed. Hence, in a double-thread chain stitch or a special stitch in which no knife is used, the upper knife is not hazardous, and the work space is sufficiently large.

The upper knife releasing device according to the first aspect of the present invention operates as follows: In the case of a chain stitch in which the upper knife is not used, the controller rotating means causes the controller to turn about the controller shaft, so as to prevent the rotation of the upper knife rocking shaft. That is, the upper knife rocking arm is not turned; i.e., held stopped.

The upper knife releasing device according to the second aspect of the present invention operates as follows: In the case of a chain stitch in which the upper knife is not used, the controller shaft moving means moves the controller shaft, so that the upper knife rocking shaft is turned with the aid of the link mechanism. As a result, the upper knife is retracted upwardly.

The upper knife releasing device according to the third aspect of the present invention operates as follows: In the case of a chain stitch in which the upper knife is not used, the change-over lever is operated, so that the stopping and the upward retracting of the upper knife rocking arm are carried out simultaneously.

The upper knife releasing device according to the fourth aspect of the present invention operates as follows: In the case of a double-thread chain stitch or special stitch in which no knife is used, the switching means is operated so that the upper knife rocking arm is decouple from the upper knife driving means being secured to the upper knife releasing hold plate located above the upper knife driving means. Hence, during the sewing operation, the upper knife is not hazardous and the work space is maintained sufficiently large.

BRIEF DESCRIPTION OF THE DRAWING(S)

Figure 11A:
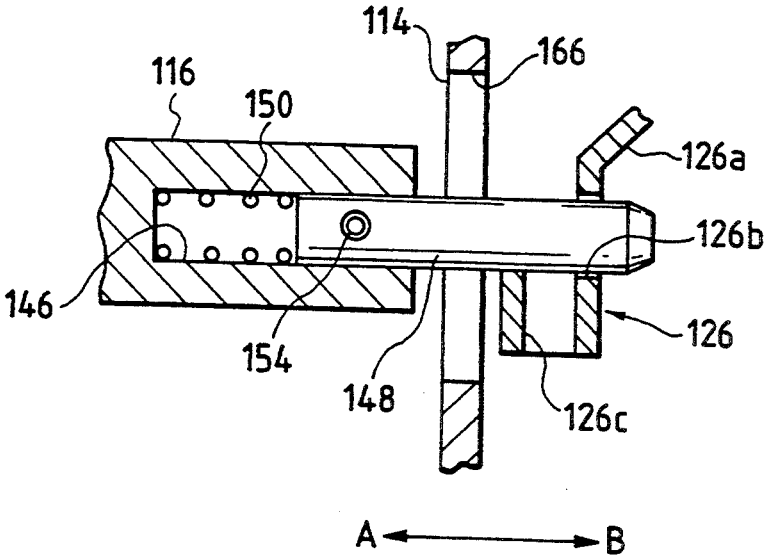
Figure 11B:
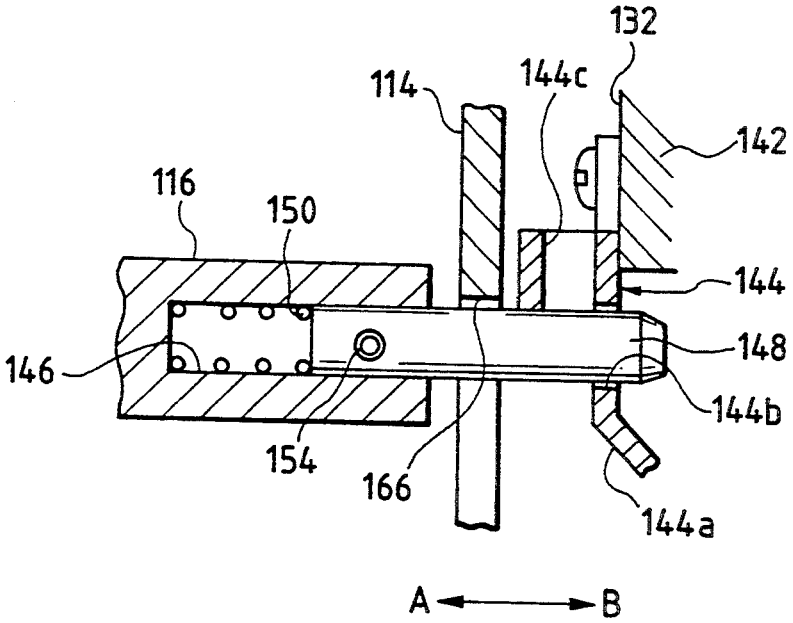
Figure 12:
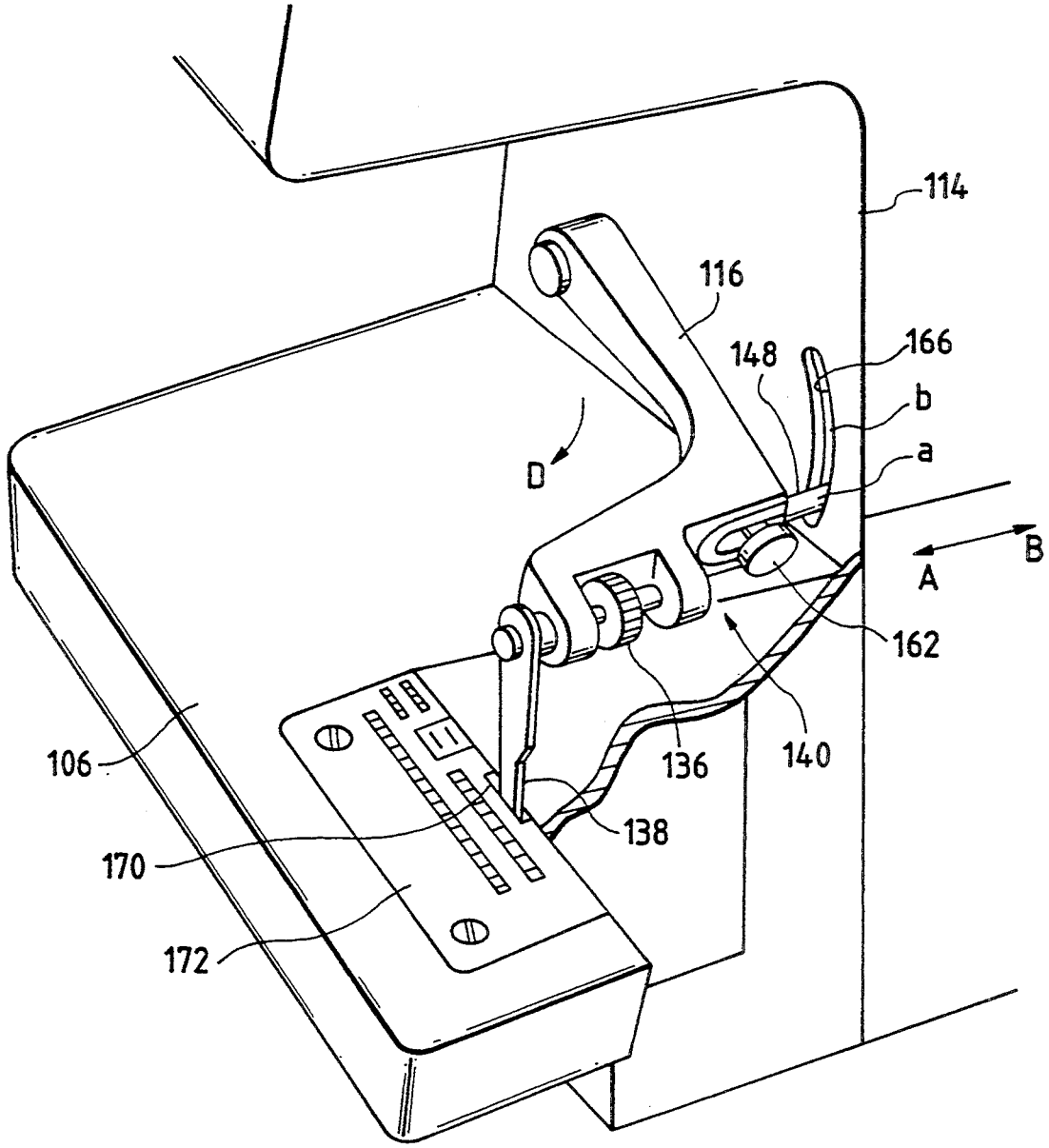
Figure 13:
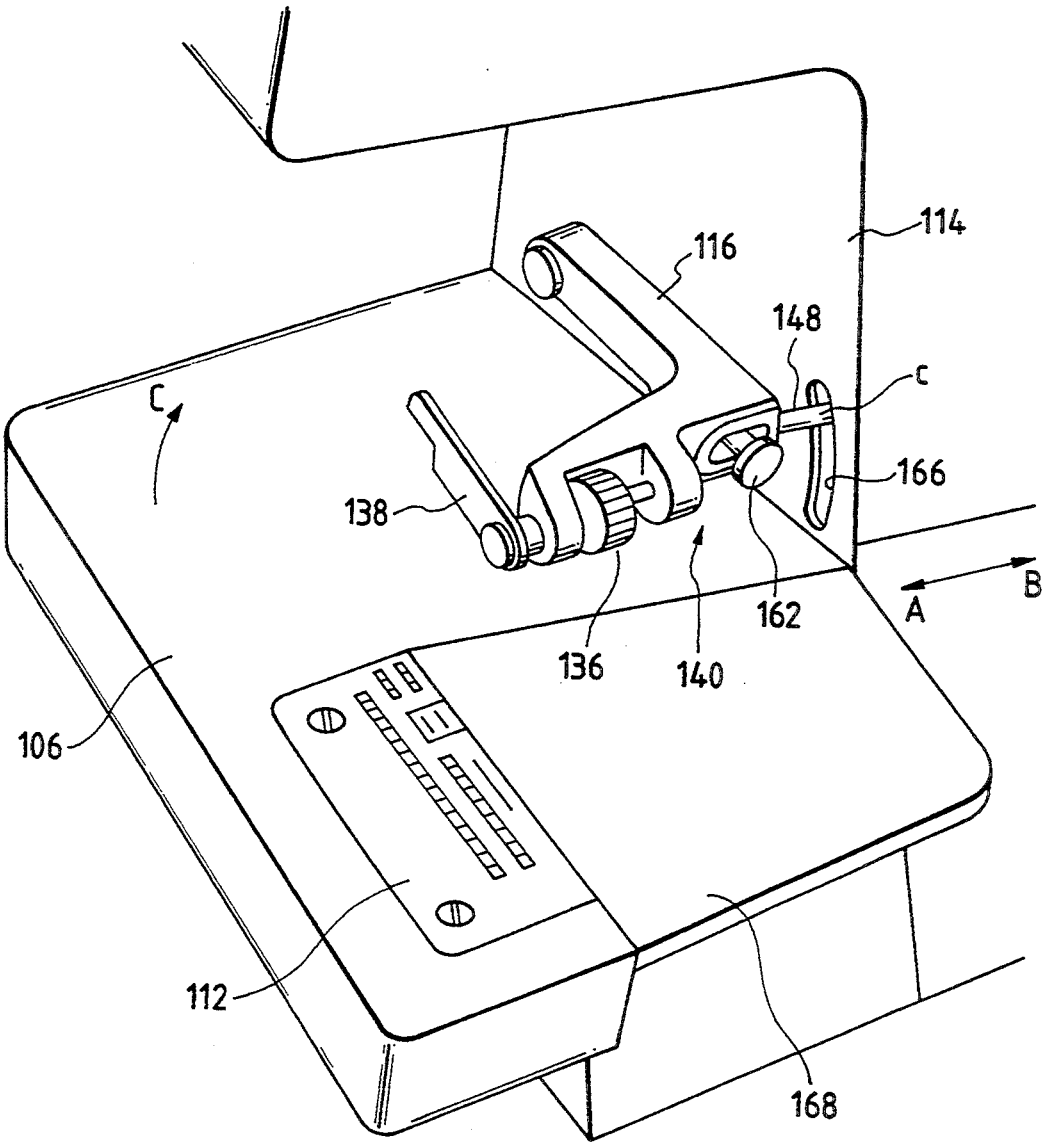

FIGS. 11(A) and 11(B) are sectional front views showing a part of the upper knife releasing device according to the invention;

FIG. 12 is a perspective views of essential parts of a sewing machine equipped with the upper knife releasing device of the invention, showing the upper knife which is in operation; and FIG. 13 is also a perspective of the essential parts of the sewing machine, showing the upper knife which has been released.

DETAILED DESCRIPTION OF THE PREFERRED EMBODIMENT(S)

An example of an upper knife releasing device in an overlock sewing machine according to the invention will be described with reference to the accompanying drawings.

Figure 1:
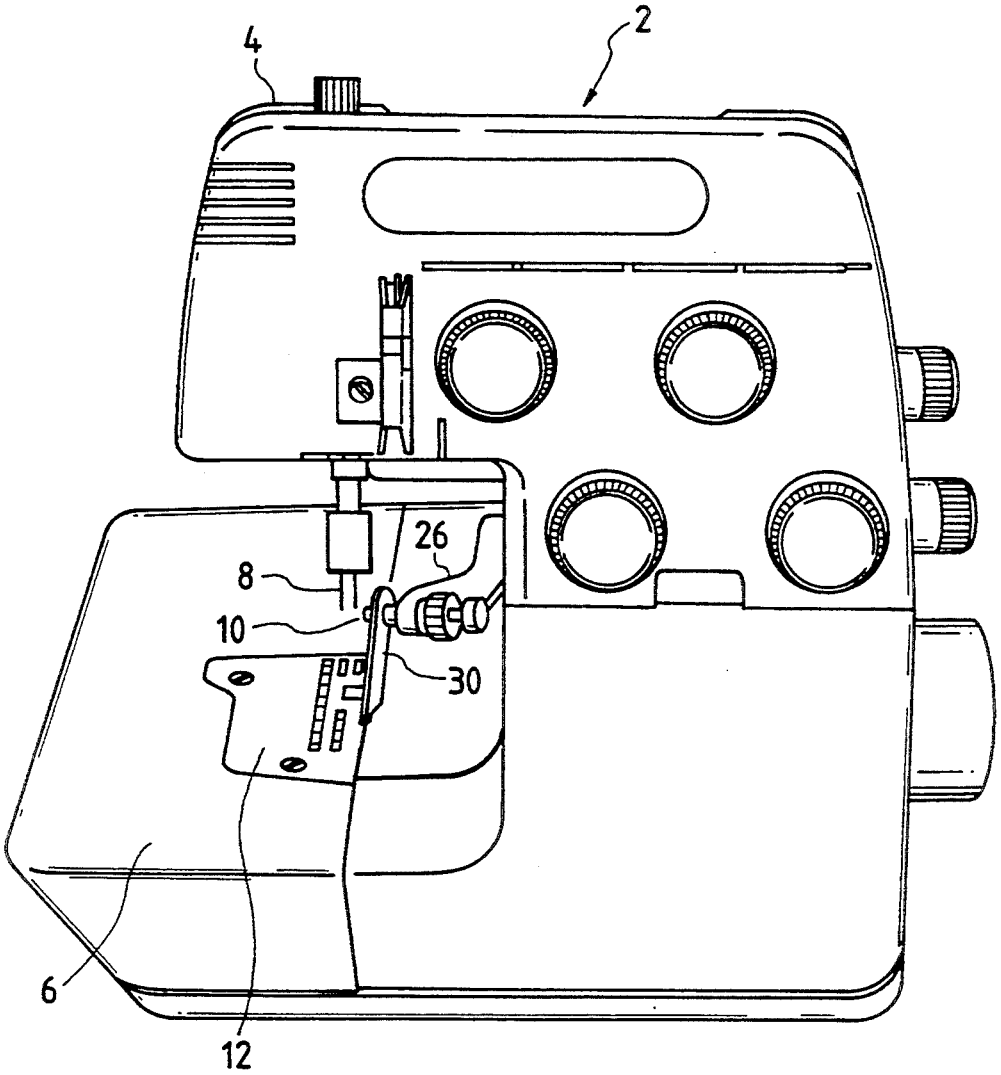
FIG. 1 is a perspective view of an overlock sewing machine to which an upper knife releasing device according to the invention may be suitably applied.

FIG. 1 is a perspective view showing the whole of an overlock sewing machine to which the upper knife releasing device of the invention is suitably applied. As shown in FIG. 1, the overlock sewing machine 2 comprises an arm 4 and a bed 6. The arm 4 has two needles 8 and 10 which are vertically movable. The bed 6 has a needle plate 12 below the needles 8 and 10.

Figure 2:
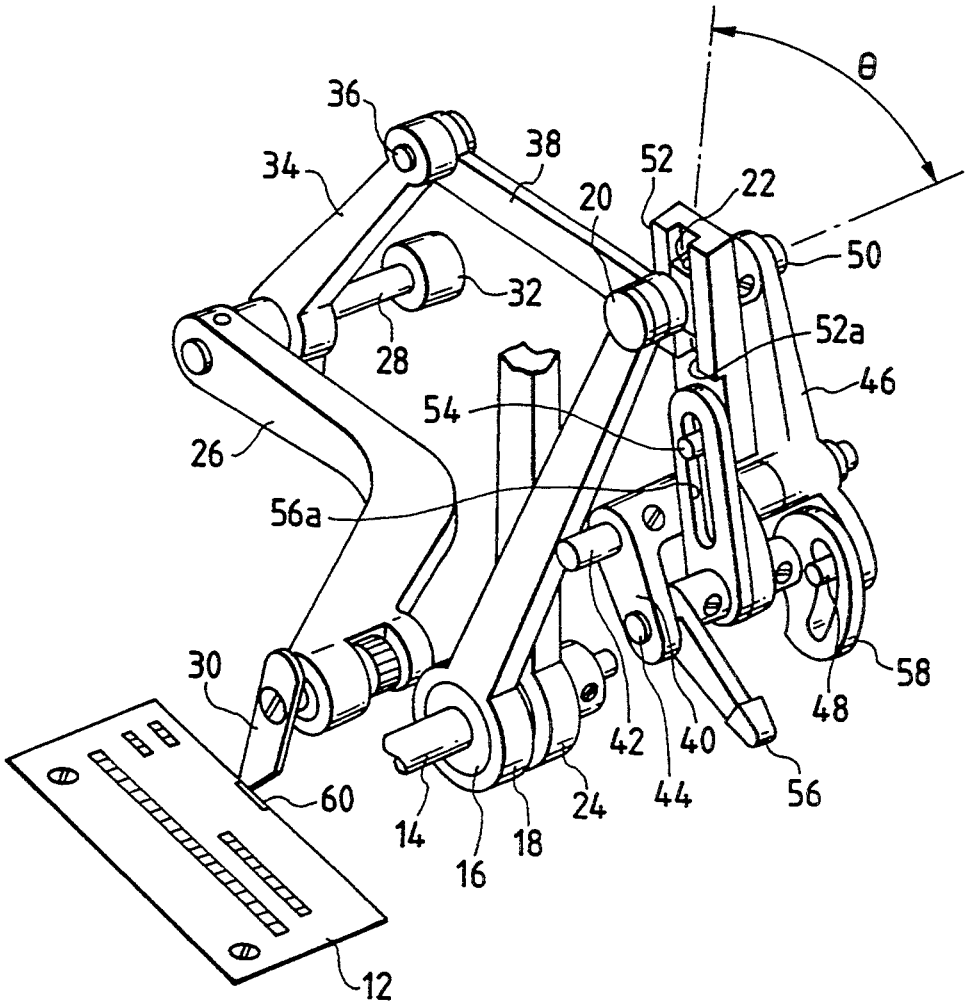
FIG. 2 is a perspective view of the upper knife releasing device according to the invention.
Figure 3:
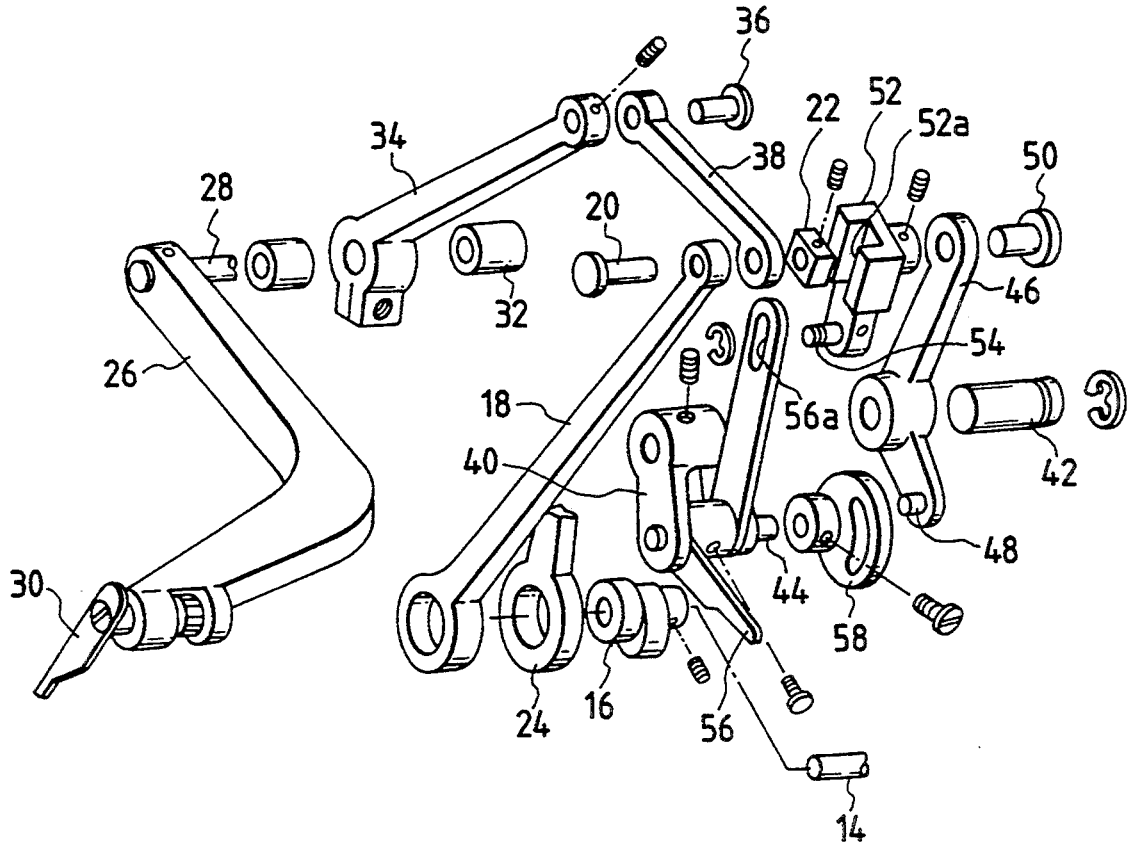
FIG. 3 is an exploded perspective view of the upper knife releasing device of the invention.
Figure 4:
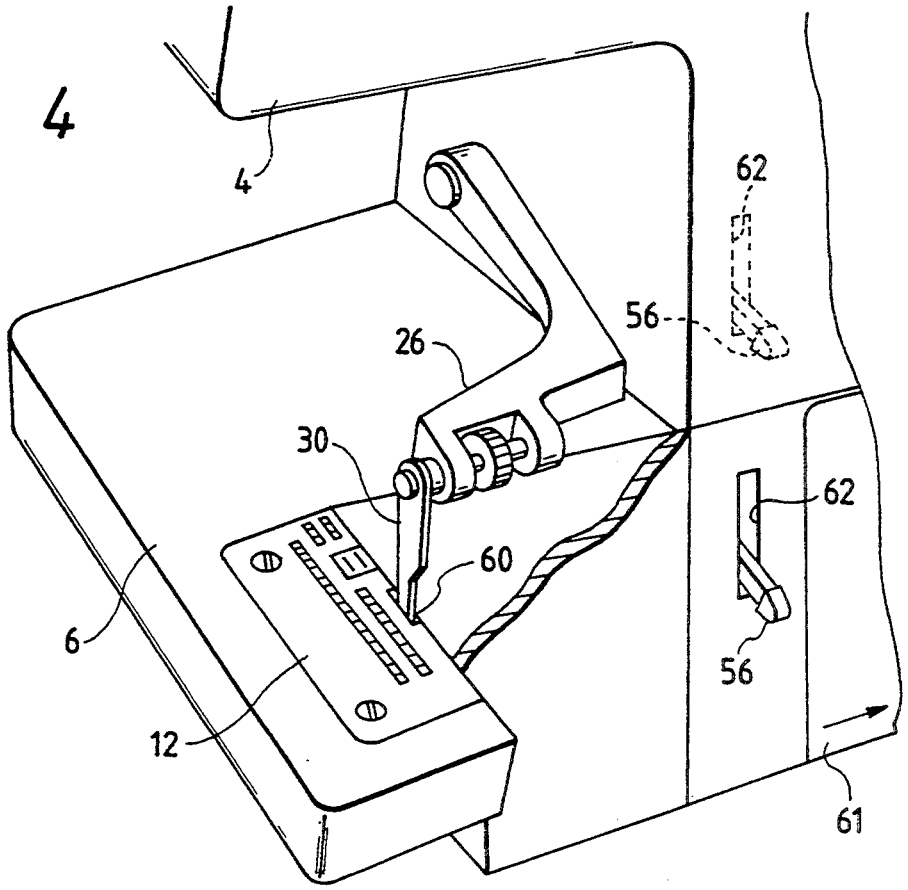
FIG. 4 is a perspective view of essential parts of the sewing machine equipped with the upper knife releasing device of the invention, showing the upper knife which is in operation.

FIG. 2 is a perspective view of the upper knife releasing device according to the invention. FIG. 3 is an exploded view of the upper knife releasing device. FIG. 4 is a perspective view showing essential parts of the sewing machine equipped with the upper knife releasing device shown in FIG. 2. FIGS. 2 and 4 show the upper knife releasing device which is in operation, thus permitting an overedge stitching operation.

As shown in those figures, an upper knife drive cam 16 is fixedly mounted on a spindle 14, and an upper knife drive rod 18 is coupled to the upper knife drive cam 16. An upper knife drive rod coupling pin 20 is inserted into the upper end portion of the upper knife drive rod 18, and is fixedly secured to a square block 22. A needle bar drive rod 24 is mounted on the spindle 14.

An upper knife rocking shaft 28 is secured to one end portion of an upper knife rocking arm 26, and an upper knife 30 is rotatably secured to the other end portion of the upper knife rocking arm 26. The upper knife rocking shaft 28 is rotatably supported by a metal part 32 which is held in a frame (not shown). An upper knife drive arm 34 is fixedly mounted on the upper knife rocking shaft 28. The upper end portion of the upper knife drive arm 34 is coupled through an upper knife drive arm coupling pin 36 and a coupling link 38 to the upper end portion of the upper knife drive rod 18. The coupling link 38 and the upper knife drive arm 34 form a link mechanism.

A change-over lever stand 40 is secured to the frame (not shown). A conversion arm shaft 42 is fixedly secured to the upper end portion of the change-over lever stand 40 thus secured. The lower end portion of the change-over lever stand 40 rotatably supports a change-over lever shaft 44. The conversion arm shaft 42 rotatably supports a conversion arm 46. A pin 48 is fixedly embedded in the lower end portion of the conversion arm 46, the upper end portion of which rotatably supports a controller shaft 50.

A controller 52 with a guide groove 52*a* is secured to the controller shaft 50. The aforementioned square block 22 is slidably fitted in the guide groove 52*a*. A conversion pin 54 is secured to the lower end portion of the controller 52.

A change-over lever 56 and a change-over cam 58 are fixedly mounted on the change-over lever shaft 44. The upper end portion of the change-over lever 56 has a slot 56*a*, with which the conversion pin 54 of the controller 52 is engaged. Hence, as the change-over lever 56 turns, the controller 52 is rotated around the axis of the controller shaft 50, changing its inclination angle $\theta$.

A slot 62 is cut in the frame inside a looper side cover 61 of the sewing machine or above it as indicated by the solid line or the dotted line in FIG. 4 so that the end portion of the change-over lever 56 is protruded outside through the slot 62. The conversion pin 54 of the controller 52, and the slot 56*a* of the change-over lever 56 form controller rotating means. The conversion arm 46 and the change-over cam 58 form controller moving means.

The upper knife releasing device is constructed as described above. Therefore, as the spindle 14 turns, the upper knife drive rod 18 is rocked vertically, so that the square block 22 is reciprocated along the guide groove 52*a* of the controller 52. In the case of an overedge stitch, the inclination angle $\theta$ of the controller 52 is set to a value with which the upper knife 30 is allowed to cut the workpiece with a predetermined stroke.

Figure 5:
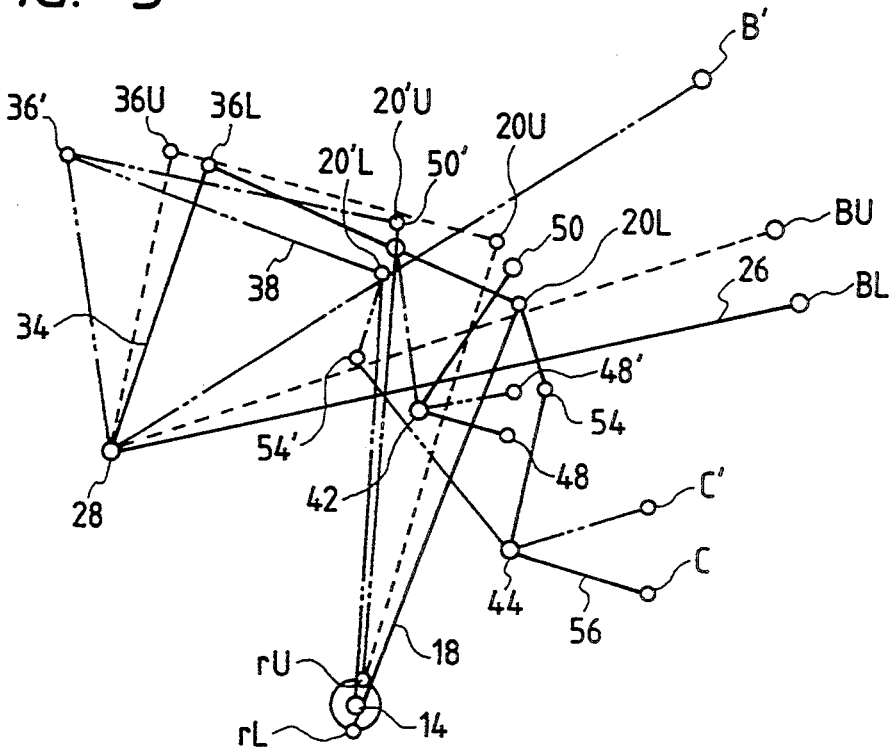
FIG. 5 is an analytic diagram for a description of the operation of various parts which are revealed when the change-over lever of the upper knife releasing device is turned.
Figure 6:
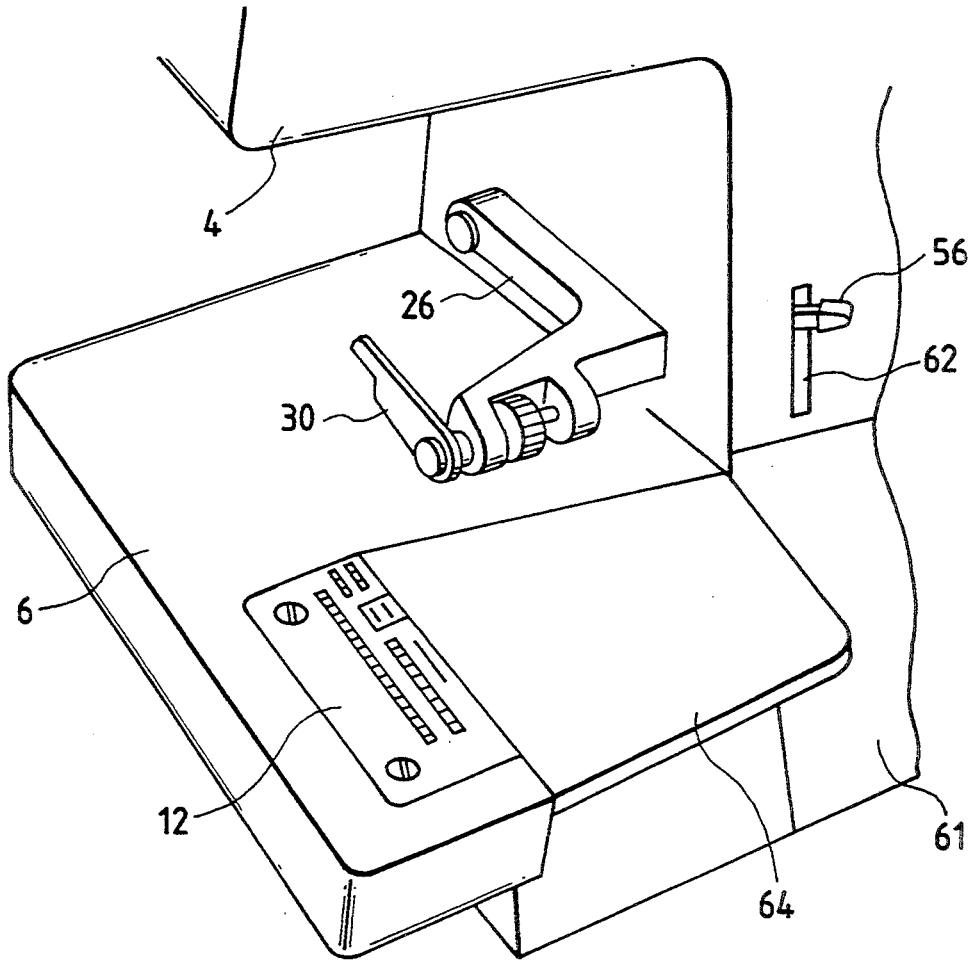
FIG. 6 is a perspective view of essential parts of the sewing machine equipped with the upper knife releasing device according to the invention, showing the upper knife which, being released, is not in operation.

FIG. 5 is an analytic diagram for a description of the operations of various parts with the operation of the change-over lever 56. FIG. 6 is a perspective view of essential parts of the sewing machine equipped with the upper knife releasing device according to the invention, showing the upper knife which has been released.

In FIG. 5, the point r represents the lower end of the upper knife drive rod 18; the point c, the end of the change-over lever 56, and the point B, the end of the upper knife rocking arm 26. Further in FIG. 5, the mark "'" added to the reference numerals or characters indicates the positions which the parts take when the upper knife is released, and the character "U" added to the reference numerals or characters indicates the top dead centers of the parts, and the character "L" added to the reference numerals or characters indicates the bottom dead centers of them.

When the end of the change-over lever 56 is at the position c (drive position) (as shown in FIGS. 2 and 4), the eccentric motion of the upper knife drive cam 16 causes the lower end r of the upper knife drive rod 18 to perform a circular motion around the spindle 14, describing a circle passing through the top dead center rU and the bottom dead center rL. Hence, the upper knife drive rod coupling pin 20 at the upper end of the upper knife drive rod 18 is rocked substantially vertically between the positions 20U and 20L, so that the square block 22 is reciprocated along the guide groove 52*a* of the controller 52. Accordingly, the upper knife rocking shaft 28 is rocked through the coupling link 38 and the upper knife drive arm 34, so that the end of the upper knife rocking arm 26 is rocked substantially vertically between the positions BU and BL. As a result, the upper knife 30 cuts the workpiece, being pushed against a lower knife 60 secured to the side of the needle plate 12.

In the case of a double chainstitch or a special stitch in which it is unnecessary to cut the workpiece, the end of the change-over lever 56 is shifted from the position c to the position c' (release position). As the change-over lever 56 is shifted in this manner, the change-over cam 58 is turned, so that the conversion arm 46 is turned through the pin 48 embedded in the lower end portion thereof. As a result, the controller 52 supported on the upper end portion of the conversion arm 46 is also turned. In this operation, the pin 48 is moved to the position 48', while the controller shaft 50 to the position 50'. As the controller 52 is moved, the upper knife drive arm coupling pin 36 is moved to the position 36' through the square block 22 and the coupling link 38, as a result of which the upper knife rocking arm 26 is greatly turned about the upper knife rocking shaft 28 to the position B'; that is, it is positioned as shown in FIG. 6. Hence, the auxiliary bed 64 can be used as illustrated in FIG. 6; that is, the work space is increased as much.

When the change-over lever 65 is turned to the release position c', the conversion pin 54 at the lower end of the controller 52 is moved to the position 54'; that is, the controller 52 is turned about the controller shaft 54. As a result, the inclination angle of the controller 52 is set to a value with which the rocking of the upper knife rocking shaft 28 (and accordingly the upper knife rocking arm 26) is not allowed. This inclination angle is such that the locus (between 20'U and 20'L) which the upper knife drive rod coupling pin 20 describes while moving along the guide groove 52*a* between the top dead center and the bottom dead center is an arc whose center is the upper knife arm coupling pin 36'.

The operation of stopping the upper knife 30, and the operation of upwardly retracting it have been described separately. However, in practice, the operation of driving the change-over lever 56 to upwardly retract the upper knife, and the operation of stopping the vertical rocking of the upper knife 30 are carried out simultaneously. And those operations can be performed no matter what the upper knife drive phase is.

In the case of a double chainstitch or a special stitch in which it is unnecessary to cut the workpiece, it is preferable that, before the change-over lever 56 is shifted to the release position, the upper knife 30 is turned backwardly as shown in FIG. 6.

Another upper knife releasing device in an overlock sewing machine according to the invention will be described with reference to the accompanying drawings.

Figure 7:
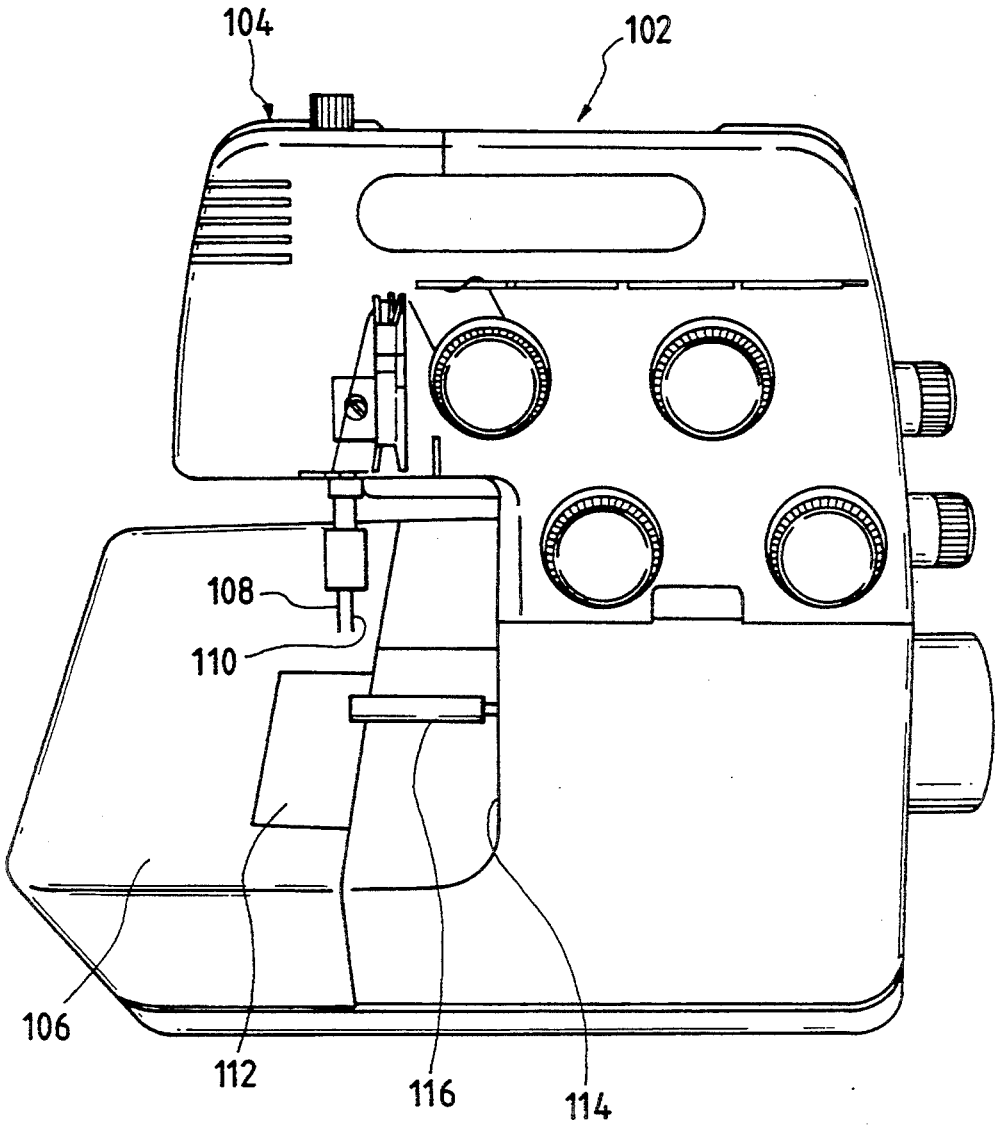
FIG. 7 is a perspective view showing the whole of an overlock sewing machine to which an upper knife releasing device of the invention is suitably applied.

In FIG. 7, reference numeral 102 designates the overlock sewing machine, which comprises an arm 104 and a bed 106. The arm 104 has one or two needles, for instance two needles 108 and 110 are shown in FIG. 7, which are vertically movable. The bed 106 has a throat plate 112 below the needles 108 and 110. The upper knife releasing device has an upper knife rocking arm 116 outside an outer casing 114 of the over-rock type sewing machine, which is protruded towards the bed 16.

Figure 8:
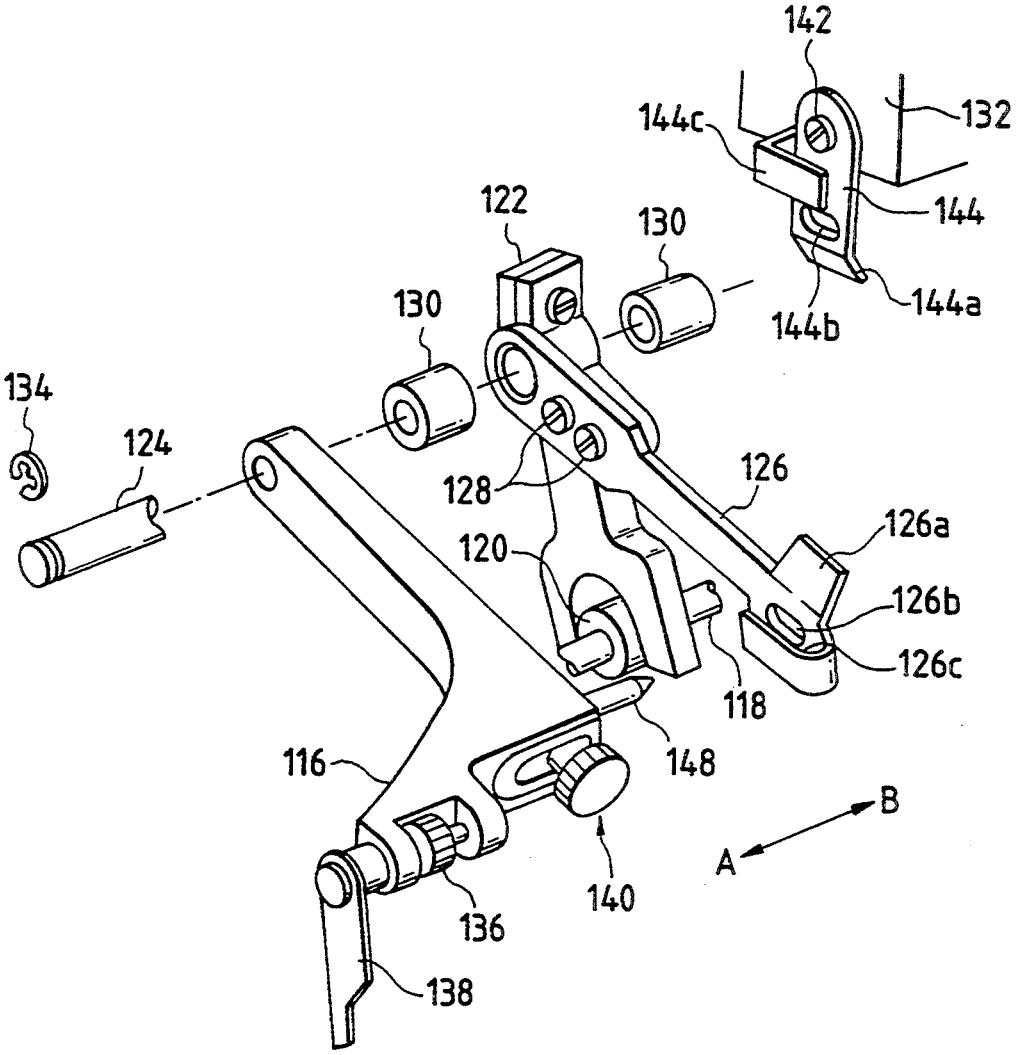
FIGS. 8 and 9 are an exploded perspective view and a plan view, respectively, showing the upper knife releasing device of the invention.
Figure 9:
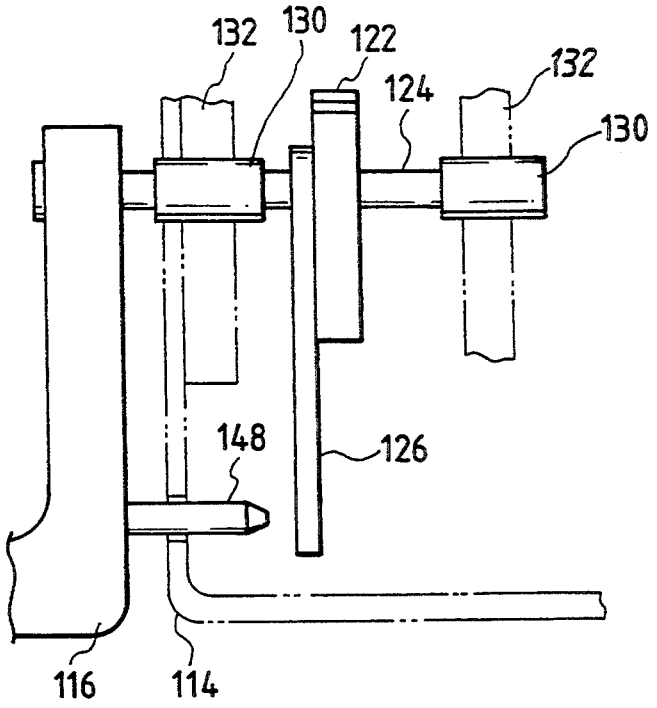

The upper knife releasing device of the invention will be described with reference to FIGS. 8 and 9 in addition to FIG. 7.

In those figures, an upper knife driving cam 120 is fixedly mounted on a spindle 118 of the sewing machine, and an upper knife driving arm 122 has a fork-shaped end portion, which is engaged with the upper knife driving cam 120. An upper knife rocking shaft 124 is extended through the outer casing 114 (cf. FIGS. 7 and 9) of the sewing machine in such a manner that it is in parallel with the spindle 118. Inside the outer casing 114, an upper knife driving plate 126 is rotatably mounted through its one end portion on the upper knife rocking shaft 124. The one end portion of the upper knife driving plate 126 is fixedly secured to the upper knife driving arm 122 with screws 128. The upper knife driving plate 126 has a sloped surface 126*a*, an end hole 126*b* and a stopper 126*c* at the other end.

The upper knife rocking arm 116 is rotatably mounted on the portion of the upper knife rocking shaft 124 which is exposed outside the outer casing 114 of the sewing machine.

The upper knife rocking shaft 124 is fixedly secured to a frame 132 with a metal part 130 set between the upper knife rocking arm 116 and the upper knife driving plate 26 and with another metal part 130 set on the right side of the latter 126. A retaining ring 134 is mounted on the upper knife rocking shaft 124, to prevent the lateral movement of the upper knife rocking arm 116.

The upper knife rocking arm 116 has an upper knife 138, upper knife turning means 136 for turning the upper knife 138, and switching means 140 at the other end. The switching means 140 is to drive the upper knife rocking arm 116 and to stop it above as described later.

In order to adjust the motion phase of the upper knife rocking arm 116, the upper knife driving plate 126 is so designed that its end portion is more or less adjustable in vertical position; that is, its fixing position on the upper knife driving arm 122 is adjustable.

An upper knife releasing hold plate 144 is fixedly secured to the frame 132 with a screw 142 inside the sewing machine. The upper knife releasing hold plate 144 has a sloped surface 144*a*, a stopper 144, and a hole 144*b*.

Figure 10:
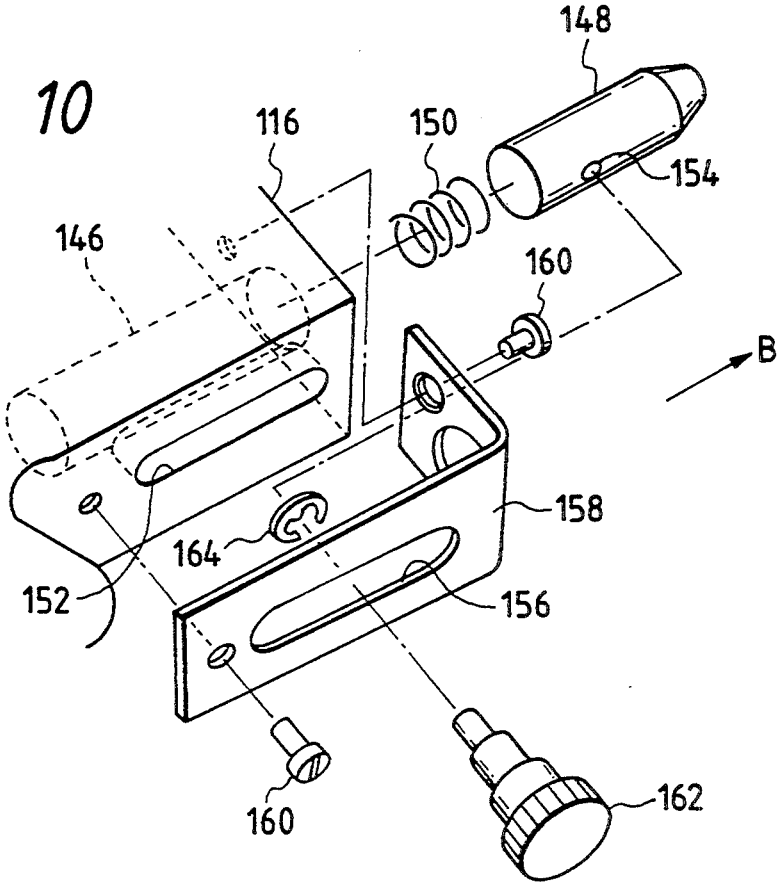
FIG. 10 is an enlarged exploded view for a description of the arrangement of switching means in the upper knife releasing device of the invention.

The arrangement of the aforementioned switching means 140 will be described with reference to FIG. 10.

An engaging hole 146 is formed in the end portion of the upper knife rocking arm 116 in such a manner that it is extended in the direction of the spindle 118. A coupling pin 148, and a coil spring 150 adapted to urge the coupling pin 148 in the direction of the arrow B, are accommodated in the engaging hole 146. Furthermore, a slot 152 is formed in the end portion of the upper knife rocking arm 116 in such a manner that it is communicated with the engaging hole 146. The coupling pin 148 has a threaded hole 154 in its cylindrical surface.

A guide plate 158 having a slot 156 is fixedly secured to the upper knife rocking arm 116 with screws 160. A coupling-pin tightening screw 162 is engaged with the threaded hole 154 of the coupling pin 148 through the slot 156 of the guide plate 158 and the slot 152 of the upper knife rocking arm 116. In this operation, a retaining ring 164 is interposed between the upper knife rocking arm 116 and the guide plate 158, and the coupling-pin tightening screw 162 is inserted into the retaining ring 164 so that, even when loosened, the coupling-pin tightening screw 162 is prevented from being disengaged from the threaded hole 154 of the coupling pin 148. Hence, as the coupling-pin tightening screw 162 is tightened, the coupling pin 148 is fixedly secured to the upper knife rocking arm 116; whereas as it is loosened, the coupling pin 148 together with the coupling-pin tightening screw 162 becomes movable to the right (in FIG. 10).

As described above, FIGS. 11(A) and 11(B) are sectional front views showing a part of the upper knife releasing device according to the invention. In the case of FIG. 11(A), the upper knife is in operation; and in the case of FIG. 11(B), the upper knife is released. And, FIGS. 12 and 13 are perspective views showing essential parts of the sewing machine including the upper knife releasing device of the invention. As shown in those figures, the outer casing 114 has an arcuate guide groove 166, in which the end portion of the coupling pin 148 is inserted. In FIG. 13, reference numeral 168 designates an auxiliary bed.

In an overedge stitch, it is necessary to set the upper knife at the operating position as shown in FIGS. 11(A) and 12. For this purpose, first the coupling-pin tightening screw 162 is loosened, and the coupling pin 148 is moved in the direction of the arrow A until it comes out of the hole 144*b* of the upper knife releasing hold plate 144, and then the upper knife rocking arm 116 is turned clockwise (in the direction of the arrow D in FIG. 12). In this operation, the coupling pin 148 is slid down the sloped surface 126*a* of the upper knife driving plate 126. The coupling pint 148 thus slid is stopped by the stopper 126*c* of the upper knife driving plate 126 and at the same time it is moved in the direction of the arrow B by the elastic force of the coil spring 150; that is, it is inserted into the hole 126*b*. Under this condition, the coupling-pin tightening screw 161 is tightened, so that the upper knife rocking arm 116 is fixedly secured to the upper knife driving plate 126; that is, the upper knife rocking arm 116 and the upper knife driving plate 126 become vertically swingable as one unit. In this case, the coupling pin 148 is allowed to move together with the upper knife rocking arm 116 along the guide groove 166, and its range of movement is between the points a and b as shown in FIG. 12. Under this condition, the upper knife turning means 136 is operated to turn the upper knife to the operating position as shown in FIG. 12 where it is set against a lower knife 170 mounted on the side of the throat plate 112. The workpiece is cut by the sliding operation of the upper knife 138 and the lower knife 170.

In the case of a double chainstitch or special stitch in which it is unnecessary to cut the workpiece, as shown in FIGS. 11(B) and 13 the upper knife is released as follows: First, the coupling-pin tightening screw 162 is loosened, and the coupling pin 148 is moved in the direction of the arrow (A) until it is disengaged from the hole 126*b* of the upper knife driving plate 126; and then the upper knife rocking arm 116 is turned counterclockwise (in the direction of the arrow C in FIG. 13) until the coupling pin 148 is moved to the position c in the guide groove 166. In this operation, the coupling pin 148 is slid up the sloped surface 144*a* of the upper knife releasing hold plate 144. The coupling pin 148 thus slid is stopped by the stopper 144*c*, and at the same time it is moved in the direction of the arrow B by the spring 150, so that it is inserted into the hole 144*b*. Under this condition, the coupling-pin tightening screw 162 is tightened, so that the upper knife rocking arm is positively held stopped above the auxiliary bed 168. In this operation, it is preferable that, before the coupling-pin tightening screw 162 is loosened, the upper knife 138 is swung in the direction of the arrow C as shown in FIG. 13.

Since the upper knife rocking arm is held above the auxiliary bed 168 in the above-described manner, the upper knife 138 is no longer hazardous; that is, the operator is prevented from touching the upper knife 138 when conducting a sewing operation over the auxiliary bed 168. In addition, the upper knife rocking arm 116 is sufficiently spaced from the auxiliary bed 168, which contributes to the improvement of the work efficiency.

In the upper knife releasing device designed as described above, the upper knife rocking arm 116 can be readily operated (set or released) from the outside of the outer casing 114 no matter where the upper knife rocking arm 116 is positioned in a vertical direction.

The upper knife releasing device according to the first aspect of the present invention operates as follows: In the case of a chain stitch in which the upper knife is not used, the controller rotating means causes the controller to turn about the controller shaft, so as to prevent the rotation of the upper knife rocking shaft. Hence, the upper knife rocking arm is held stopped; that is, it is not hazardous.

The upper knife releasing device according to the second aspect of the present invention operates as follows: In the case of a chain stitch in which the upper knife is not used, the controller shaft moving means moves the controller shaft, so that the upper knife rocking shaft is turned with the aid of the link mechanism. As a result, the upper knife is retracted upwardly, and accordingly the working space is increased as much.

The upper knife releasing device according to the third aspect of the present invention operates as follows: In the case of a chain stitch in which the upper knife is not used, the change-over lever is operated, so that stopping and upward retracting of the upper knife rocking arm are carried out at the same time, and accordingly the work space can be increased safely and readily.

The upper knife releasing device according to the fourth aspect of the present invention operates as follows: In the case of a double-thread chain stitch or special stitch in which no knife is used, the switching means is operated so that the upper knife rocking arm is decouple from the upper knife driving means being secured to the upper knife releasing hold plate located above the upper knife driving means. Hence, during the sewing operation, the upper knife is not hazardous and the work space is maintained sufficiently large.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An upper knife releasing device for an overlock sewing machine, comprising:

an upper knife rocking arm to which a cloth cutting upper knife is secured;

an upper knife rocking shaft fixedly secured to said upper knife rocking arm and rotatably supported relative to a frame;

a controller shaft movable relative to said frame;

a controller rotatable about said controller shaft, said controller having a guide groove therein;

a link mechanism having a first portion secured within and substantially linearly reciprocated along an axial length of said guide groove, and a second portion fixedly secured to said upper knife rocking shaft; and controller rotating means for controlling the rotational angle of said guide groove of said controller to selectively impart movement to the upper knife rocking arm when the first portion of the link mechanism reciprocates along the guide groove.

2. An upper knife releasing device according to claim 1, further comprising:

controller shaft moving means for moving said controller shaft so that said upper knife rocking arm is moved downwardly in the case of the stitch in which said knife is used, and said upper knife rocking arm is retracted upwardly in the case of the stitch in which said knife is not used.

3. An upper knife releasing device according to claim 2, further comprising:

a change-over member for simultaneously allowing said controller rotating means and said controller shaft moving means to operate.

4. An upper knife releasing device according to claim 2, in which said controller shaft rotating means comprises:

a conversion arm having one end rotatably mounted on said controller shaft and the other end in which a pin is fixedly embedded; and a change-over cam having a cam surface with which said pin of said conversion arm is engaged, wherein said controller shaft is moved in accordance with the movement of said conversion arm between a position in which said upper knife rocking arm is moved downwardly and a position in which said upper knife rocking arm is retracted upwardly.

5. An upper knife releasing device according to claim 1, in which said link mechanism comprises:

an upper knife drive arm having one end fixedly mounted on the upper knife rocking shaft; and a coupling link having one end which is substantially linearly reciprocated along said guide groove, where in the other end of said upper knife drive arm and the other end of said coupling link are pivotably coupled with each other through an upper knife drive arm coupling pin.

6. An upper knife releasing device according to claim 1, in which said controller rotating means comprises:

a conversion pin secured to the lower end portion of said controller; and a change-over member turnable about an axis of a change-over lever shaft, said change-over member having a slot with which said conversion pin is engaged, wherein when said change-over member is turned about the axis of said change-over lever shaft, said controller is rotated around the axis of said controller shaft.

7. An upper knife releasing device according to claim 1, wherein the knife is pivotally attached to the rocking arm.

8. An upper knife releasing device for an overlock sewing machine, comprising:

an upper knife rocking arm to which a cloth cutting upper knife is secured;

an upper knife rocking shaft fixedly secured to said upper knife rocking arm and rotatably supported relative to a frame;

a controller shaft movable relative to said frame;

a controller rotatable about said controller shaft, said controller having a guide groove;

a link mechanism having a first portion secured within and substantially linearly reciprocated along an axial length of said guide groove, and a second portion fixedly secured to said upper knife rocking shaft; and controller shaft moving means for moving said controller shaft so that said upper knife rocking arm is moved downwardly in the case of a stitch in which said knife is used, and said upper knife rocking arm is retracted upwardly in the case of a stitch in which said knife is not used.

9. An upper knife releasing device according to claim 8, in which said link mechanism comprises:

an upper knife drive arm having one end fixedly mounted on the upper knife rocking shaft; and a coupling link having one end which is substantially linearly reciprocated along said guide groove, where in the other end of said upper knife drive arm and the other end of said coupling link are rotatably coupled with each other through an upper knife drive arm coupling pin.

10. An upper knife releasing device according to claim 8, in which said controller shaft rotating means comprises:

a conversion arm having one end rotatably mounted on said controller shaft and the other end in which a pin is fixedly embedded; and a change-over cam having a cam surface with which said pin of said conversion arm is engaged, wherein said controller shaft is moved in accordance with the movement of said conversion arm between a position in which said upper knife rocking arm is moved downwardly and a position in which said upper knife rocking arm is retracted upwardly.

11. An upper knife releasing device according to claim 8, wherein the knife is pivotally attached to the rocking arm.

12. An upper knife releasing device for an overlock sewing machine, comprising:

an upper knife rocking arm to which a cloth cutting upper knife is secured;

an upper knife rocking shaft fixedly secured to said upper knife rocking arm and rotatably supported relative to a frame;

a controller shaft movable relative to said frame;

a controller rotatable about said controller shaft, said controller having a guide groove;

a link mechanism having a first portion secured within and substantially linearly reciprocated along an axial length of said guide groove, and a second portion fixedly secured to said upper knife rocking shaft;

controller rotating means for controlling the rotational angle of said guide groove of said controller to selectively impart movement to the upper knife rocking arm when the first portion of the link mechanism reciprocates along the guide groove;

controller shaft moving means for moving said controller shaft so that said upper knife rocking arm is moved downwardly in the case of the stitch in which said knife is used, and said upper knife rocking arm is retracted upwardly in the case of the stitch in which said knife is not used; and a change-over member for simultaneously allowing said controller rotating means and said controller shaft moving means to operate.

13. An upper knife releasing device according to claim 12, in which said link mechanism comprises:

an upper knife drive arm having one end fixedly mounted on the upper knife rocking shaft; and a coupling link having one end which is substantially linearly reciprocated along said guide groove, where in the other end of said upper knife drive arm and the other end of said coupling link are rotatably coupled with each other through an upper knife drive arm coupling pin.

14. An upper knife releasing device according to claim 12, wherein the knife is pivotally attached to the rocking arm.

15. An upper knife releasing device for an overlock sewing machine comprising:

an upper knife rocking arm to which a cloth cutting upper knife is secured;

upper knife driving means for rocking said upper knife rocking arm vertically;

an upper knife releasing hold plate secured to a sewing machine frame located above said upper knife driving means; and switching means for coupling said upper knife rocking arm to said upper knife driving means in the case of a stitch in which a knife is used, and fixing said upper knife rocking arm to said upper knife releasing hold plate in the case of a stitch in which said knife is not used.

16. An upper knife releasing device as claimed in claim 15, in which said switching means is provided on an outer casing of said overlock sewing machine.

17. An upper knife releasing device as claimed in claim 16, further comprising:

a coupling pin;

elastic means for urging said coupling pin away from said upper knife rocking arm; and holding means for holding and releasing said coupling pin with respect to said upper knife rocking arm:

wherein said upper knife driving means and said upper knife releasing hold plate each has an engaging hole with which said coupling pin is engageable; and said coupling pin is engaged with said engaging hole of said upper knife driving means in the case of a stitch in which said knife is used, and engaged with said engaging hole of said upper knife releasing hold plate in the case of a stitch in which said knife is not used, to secure said upper knife rocking arm to said upper knife releasing hold plate.

18. An upper knife releasing device as claimed in claim 17, wherein said upper knife driving means includes;

a sloped surface, and a stopper for preventing the downward movement of said coupling pin:

said upper knife releasing hold plate includes;

a sloped surface, and a stopper form preventing the upward movement of said coupling pin: and in the case of a stitch in which said knife is used, said coupling pin being slid down said sloped surface of said upper knife driving means until said coupling abuts against said stopper, thus being engaged with said engaging hole, and in the case of a stitch in which said knife is not used, said coupling pin being slid up said sloped surface of said upper knife releasing hold plate until said coupling pin abuts against said stopper, thus being engaged with said engaging hole.

19. An upper knife releasing device as claimed in claim 15, further comprising:

a coupling pin;

elastic means for urging said coupling pin away from said upper knife rocking arm; and holding means for holding and releasing said coupling pin with respect to said upper knife rocking arm:

wherein said upper knife driving means and said upper knife releasing hold plate each has an engaging hole with which said coupling pin is engageable; and said coupling pin is engaged with said engaging hole of said upper knife driving means in the case of a stitch in which said knife is used, and engaged with said engaging hole of said upper knife releasing hold plate in the case of a stitch in which said knife is not used, to secure said upper knife rocking arm to said upper knife releasing hold plate.

20. An upper knife releasing device as claimed in claim 19, wherein said upper knife driving means includes;

a sloped surface, and a stopper for preventing the downward movement of said coupling pin:

said upper knife releasing hold plate includes;

a sloped surface and a stopper form preventing the upward movement of said coupling pin: and in the case of a stitch in which said knife is used, said coupling pin being slid down said sloped surface of said upper knife driving means until said coupling abuts against said stopper, thus being engaged with said engaging hole, and in the case of a stitch in which said knife is not used, said coupling pin being slid up said sloped surface of said upper knife releasing hold plate until said coupling pin abuts against said stopper, thus being engaged with said engaging hole.

* * * * *

UNITED STATES PATENT AND TRADEMARK OFFICE

CERTIFICATE OF CORRECTION

PATENT NO. : 5,427,041

DATED : June 27, 1995

INVENTOR(S) : Shiro SATOMA

It is certified that error appears in the above-indentified patent and that said Letters Patent is hereby corrected as shown below:

In Abstract, line 5, "an" should read --a--.

Claim 9, column 12, line 7 and Claim 13, column 12, line 62, "where in" should read --wherein--.

Claim 18, column 13, lines 40 and 44 and
Claim 20, column 14, lines 31 and 35, "includes;" should read --includes:--.

Claim 18, column 13, line 46 and Claim 20, column 14, line 37, "form" should read --for--.

Claim 18, column 13, lines 43 and 47 and

UNITED STATES PATENT AND TRADEMARK OFFICE

CERTIFICATE OF CORRECTION

PATENT NO. : 5,427,041

DATED : June 27, 1995

INVENTOR(S) : Shiro SATOMA

It is certified that error appears in the above-indentified patent and that said Letters Patent is hereby corrected as shown below:

Claim 20, column 14, lines 34 and 38, "pin:" should read --pin;--.

Signed and Sealed this

Twenty-eighth Day of May, 1996

Bruce Lehman

*Attest:*

BRUCE LEHMAN

*Attesting Officer*

*Commissioner of Patents and Trademarks*